US009598897B2

(12) United States Patent
Davis et al.

(10) Patent No.: US 9,598,897 B2
(45) Date of Patent: Mar. 21, 2017

(54) PORTABLE CURTAIN RETRACTION DEVICE AND SYSTEM

(75) Inventors: Adam Davis, Lancaster, PA (US); James Fairorth, Lancaster, PA (US); Michael Tait, Lititz, PA (US)

(73) Assignee: Tait Towers Manufacturing, LLC, Lititz, PA (US)

( * ) Notice: Subject to any disclaimer, the term of this patent is extended or adjusted under 35 U.S.C. 154(b) by 1141 days.

(21) Appl. No.: 11/766,417

(22) Filed: Jun. 21, 2007

(65) Prior Publication Data

US 2008/0314528 A1 Dec. 25, 2008

(51) Int. Cl.
*E06B 9/36* (2006.01)
*A47H 5/032* (2006.01)

(52) U.S. Cl.
CPC ..... *E06B 9/36* (2013.01); *A47H 5/0325* (2013.01)

(58) Field of Classification Search
CPC ..... E05Y 2400/61; E05Y 2400/612; E05Y 2400/614; E06B 9/68; E06B 9/08; E06B 9/40; E06B 9/36; A47H 5/0325; B66D 1/26; B66D 1/46; B66D 2700/0166; A63J 1/02; A63J 1/028
USPC ..... 160/84.02, 331, 120; 254/292; 472/78; 318/68
See application file for complete search history.

(56) References Cited

U.S. PATENT DOCUMENTS 1,084,781 A 1/1914 Behrle
1,407,248 A 2/1922 Brown
1,651,985 A 12/1927 Allen
1,894,833 A 1/1933 Ruby et al.
1,900,677 A 3/1933 Weidhaas et al.
2,002,268 A * 5/1935 Lassen et al. ..... 160/331
2,407,024 A * 9/1946 Lohmuller et al. ..... 160/126
2,626,375 A * 1/1953 Fischer ..... 318/67
2,676,654 A 4/1954 Vallen
3,141,497 A 7/1964 Griesser
3,310,099 A 3/1967 Hunter et al.
4,062,519 A 12/1977 Jacobs
4,289,997 A * 9/1981 Jung et al. ..... 318/113
4,828,003 A 5/1989 Kraeutler
4,902,953 A * 2/1990 Kraft et al. ..... 318/663
5,029,629 A 7/1991 Cheng-Pei
5,672,943 A * 9/1997 Vivers ..... 318/103
(Continued)

FOREIGN PATENT DOCUMENTS

GB 190726231 11/1908
JP 05-049531 3/1993
(Continued)

*Primary Examiner* — Blair M Johnson
(74) *Attorney, Agent, or Firm* — McNees Wallace & Nurick LLC

(57) ABSTRACT

A portable barrier retraction device having a drive motor with an addressable drive motor control. The drive motor control is capable of being connected in a serial arrangement with one or more other addressable drive motor controls. The drive motor is in rotational communication with at least one retraction assembly configured to retract or deploy a line in response to rotation of the drive motor. The line is configured to retract or deploy a barrier. The drive motor provides selective rotation in response to an addressed signal from a controller. In addition, retraction systems employing portable retraction devices and methods for assembling the retraction systems are also disclosed.

19 Claims, 9 Drawing Sheets

(56) References Cited

U.S. PATENT DOCUMENTS

| | | | | |
|---|---|---|---|---|
| 5,739,648 | A * | 4/1998 | Ellis et al. | 318/112 |
| 5,816,306 | A * | 10/1998 | Giacomel | 160/6 |
| 6,188,190 | B1 * | 2/2001 | Arakawa | 318/560 |
| 6,501,648 | B2 * | 12/2002 | Huang et al. | 361/679.48 |
| 6,736,184 | B2 | 5/2004 | Eaton | |
| 6,983,783 | B2 * | 1/2006 | Carmen et al. | 160/120 |
| 7,038,421 | B2 * | 5/2006 | Trifilo | 318/625 |
| 7,148,635 | B1 * | 12/2006 | Piefer et al. | 318/85 |
| 2001/0045806 | A1 * | 11/2001 | Morita | 318/567 |
| 2004/0160206 | A1 * | 8/2004 | Komaki et al. | 318/569 |
| 2004/0207357 | A1 * | 10/2004 | Aoyama et al. | 318/625 |
| 2007/0120516 | A1 * | 5/2007 | Kurakake et al. | 318/625 |
| 2007/0194728 | A1 * | 8/2007 | Beifus | 318/66 |
| 2008/0052417 | A1 * | 2/2008 | Aoyama et al. | 710/1 |
| 2008/0123723 | A1 * | 5/2008 | Aoyama et al. | 375/220 |
| 2008/0314528 | A1 * | 12/2008 | Davis et al. | 160/84.02 |

FOREIGN PATENT DOCUMENTS

| | | |
|---|---|---|
| JP | 07-265553 | 10/1995 |
| JP | 08-140826 | 4/1996 |
| JP | 2002-078603 | 3/2002 |

* cited by examiner

PORTABLE CURTAIN RETRACTION DEVICE AND SYSTEM

FIELD OF THE INVENTION

The present invention is directed to portable retraction devices. In particular, the present invention is directed to a portable retraction device and system for theatrical barriers.

BACKGROUND OF THE INVENTION

In the production of many theatrical events, including concerts and public events, barriers or curtains are utilized to provide particular visual effects. For example, an opaque curtain may be utilized prior to the performance to conceal areas from view, while providing a decorative surface for viewing by the audience. Other visual effects may also be provided wherein, for example, transparent or semi-transparent material may be utilized to create various visual effects by front-lighting, back-lighting or by projecting images thereon. These barriers are typically retractable, partially or fully out of view by the audience and/or may be retracted or drawn in a decorative festoon pattern, such as in an Austrian-type or French-type curtain.

The retraction systems for theatrical barriers have typically included manual drawing of strings or cables from a central location, typically at one of the sides of the curtain. Some known systems have utilized motors to provide the drawing of the strings or cables from the central location. These known systems suffer from the drawback that they are not sufficiently portable, they do not provide flexibility in measuring the lengths of the strings drawing the curtain, resulting in an uneven presentation, and/or they are cumbersome or time-consuming to erect.

What is needed is a portable system that requires little time for assembly and disassembly, and allows the lines to be individually sized to facilitate easy adjustment.

SUMMARY OF THE INVENTION

One aspect of the present invention includes a portable barrier retraction device having a drive motor with an addressable drive motor control. The drive motor control is capable of being connected in a serial arrangement with one or more other addressable drive motor controls. The drive motor is in rotational communication with at least one retraction assembly configured to retract or deploy a line in response to rotation of the drive motor. The line is configured to retract or deploy a barrier. The drive motor provides selective rotation in response to an addressed signal from a controller.

Another aspect of the present invention includes a portable barrier retraction system. The system includes a barrier having at least one line disposed adjacent thereto. In addition, the system has a controller capable of providing an addressed signal. At least one barrier retraction device is detachably affixed to a support frame. In addition, the barrier retraction device includes a drive motor having an addressable drive motor control. The drive motor control is connected in a serial arrangement with one or more other addressable drive motor controls. The drive motor is in rotational communication with at least one retraction assembly configured to retract or deploy the line in response to rotation of the drive motor, the line being configured to retract or deploy the barrier. The drive motor provides selective rotation in response to an addressed signal from the controller.

Still another aspect of the present invention includes a method for assembling a portable stage. The method includes providing a support frame and attaching at least one portable barrier retraction device to the support frame. The portable barrier retraction device has a drive motor having an addressable drive motor control. The drive motor control is capable of being connected in a serial arrangement with one or more other addressable drive motor controls; and the drive motor being in rotational communication with at least one retraction assembly configured to retract or deploy a line in response to rotation of the drive motor, the line being configured to retract or deploy a barrier. The drive motor provides selective rotation in response to an addressed signal from a controller. The barrier is attached to one of the barrier retraction device or the support frame. The barrier retraction device is connected into a network with a cable. A controller is provided capable of providing addressed signals and power to the motor control via the cable.

An advantage of an embodiment of the present invention is that the system of the present invention is portable and allows sufficient disassembly of the components to permit transport over land, sea or by air.

Another advantage of an embodiment of the present invention is that the detachable components, including the drum for drawing in and deploying the lines and the barrier, are easily and quickly replaceable in the event of malfunction or damage.

Still another advantage of an embodiment of the present invention is that the devices for drawing in and deploying the line are interchangeable and permit easier manufacture and configuration of components in systems having a plurality of barrier retraction devices.

Still another advantage of an embodiment of the present invention is that the device may be assembled onto frames of substantially any geometry and at substantially any or variable heights, providing for easy installation.

Still another advantage of an embodiment of the present invention is that assembly/disassembly of the portable retraction devices may be accomplished quickly and easily requiring little or no technical skill.

Still another advantage of an embodiment of the present invention is that individual retraction devices are independently controllable to permit individual sizing of the lines, allowing for quicker installation and reduced error in setup.

Other features and advantages of the present invention will be apparent from the following more detailed description of the preferred embodiment, taken in conjunction with the accompanying drawings which illustrate, by way of example, the principles of the invention.

BRIEF DESCRIPTION OF THE DRAWINGS

Wherever possible, the same reference numbers are used throughout the drawings to refer to the same or like parts.

DETAILED DESCRIPTION OF THE INVENTION

Figure 1:
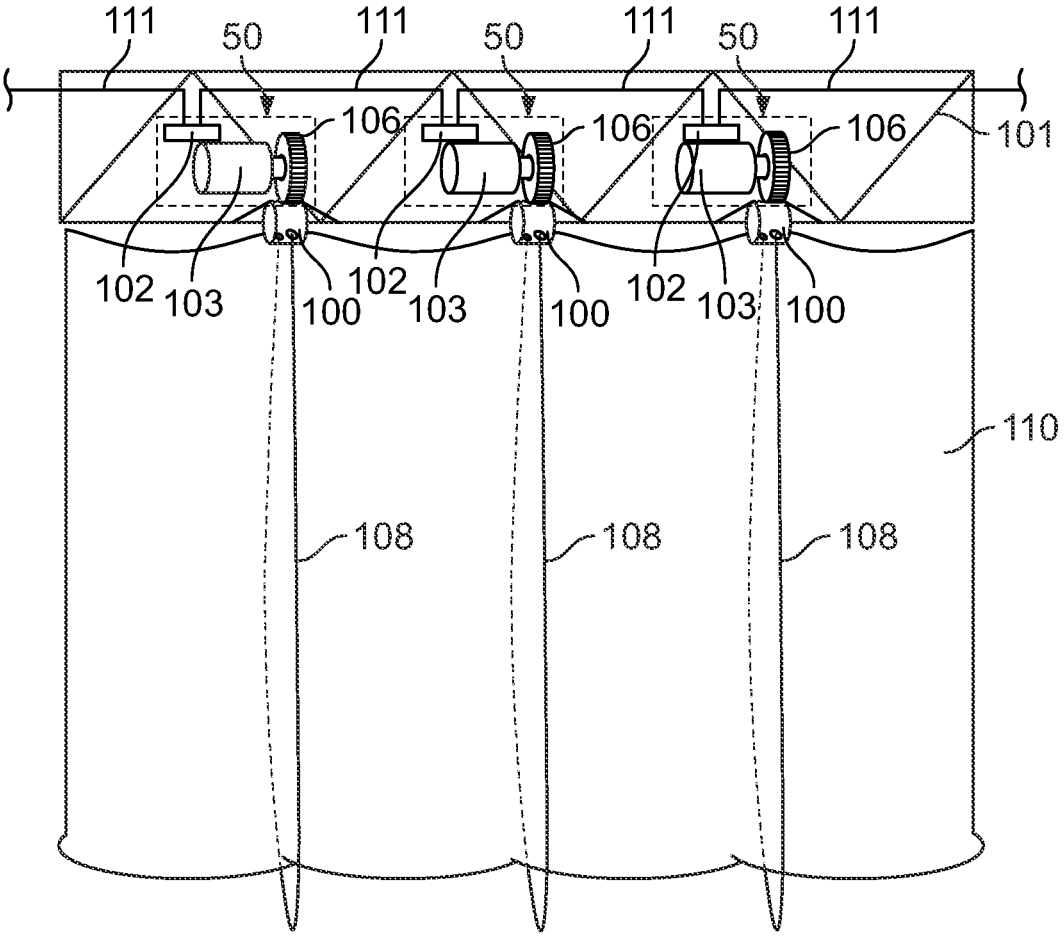
FIG. 1 shows a perspective elevational view of a barrier retraction system according to an embodiment of the present invention.

FIG. 1 shows a portable barrier retraction system that includes a portable barrier retraction device 50 mounted to a support frame 101 having deployed soft-goods or barrier 110, shown as an Austrian-type curtain. Barrier 110 is preferably soft-goods, such as a curtain, fabric, sheet, tarp or screen, or other retractable barrier material that provides the desired visual effect. For example, barrier 110 may form a scalloped or festooned appearance along one or more edges of the barrier 110 while being retracted and preferably maintains the festooned appearance in the retracted barrier 110. The festooning may be provided by drawing lines 108 into a detachable drum 100 resulting in a shorted line 108 around or attached to barrier 110, thereby drawing the barrier 110 upward with respect to the direction of gravity. Likewise, a retracted barrier 110 may be deployed, wherein line 108 is lengthened and barrier 110 is allowed to extend downward, preferably assisted by force of gravity. Line 108 may be any suitable flexible elongated device or material including, but not limited to, rope, wire, tape, fabric, braid or cord. In addition, in the embodiment shown in FIGS. 1-3, the barrier 110 may be attachable to a detachable drum 100 by any suitable attachment device. The detachable drum 100 is detachable in that the component may be detached from the support frame 101 or from portable barrier retraction device 50 for individual repair, replacement, storage and/or transportation. The barrier 110 is preferably sufficiently detachable from drum 100, support frame 101 or portable barrier retraction device 50 to permit removal, repair and/or replacement of barrier 110.

Figure 2:
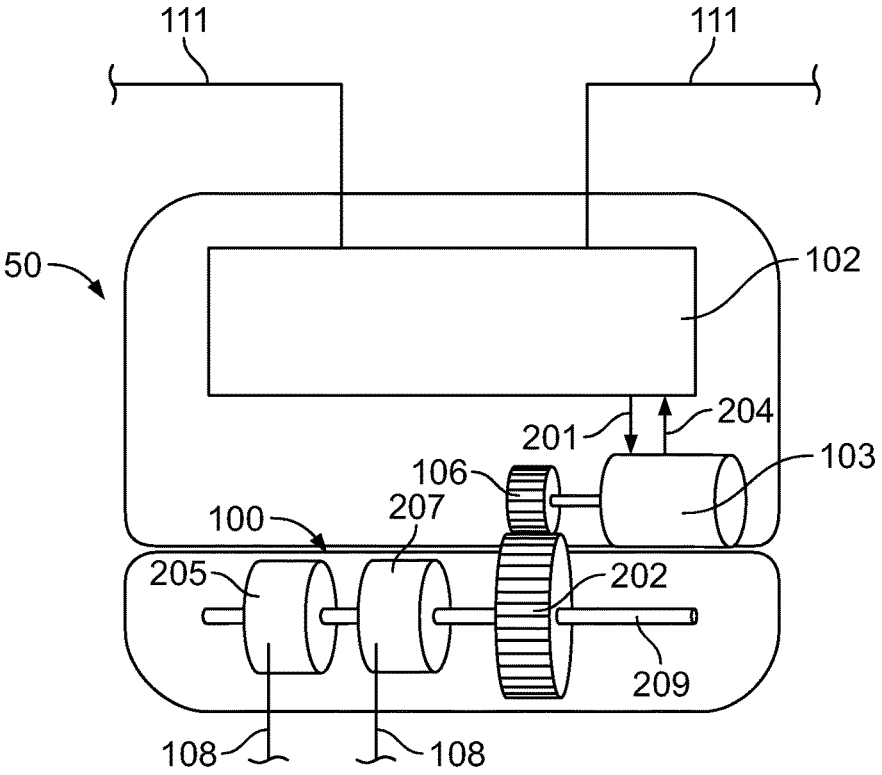
FIG. 2 shows an enlarged view of a barrier retraction device according to an embodiment of the present invention.

As shown in FIG. 1, portable barrier retraction device 50 includes a retraction assembly including a motor controller 102, drive motor 103 and detachable drum 100. Drum 100 is in rotational communication with drive motor 103 via a gear 106 or similar rotational translating device. Rotational communication, as utilized herein, includes any manner in which rotation of the drive motor 103 may be imparted to the drum 100. Although FIG. 1 includes drum 100, the drive motor 103 may directly operate spools 205, 207 or similar devices to deploy or retract lines 108 (see e.g., FIGS. 4-5). In addition to gear 106, other suitable arrangement providing rotation communication may include geared arrangements, drive belts, direct frictional contact, or any other combination of devices that result in rotational movement of drum 100 in response to rotational movement of drive motor 103. It is to be understood that there is no fixed ratio between rotation of drive motor 103 and drum 100. In one embodiment, detachable drum 100 as shown in FIG. 2, includes a geared arrangement, shown as retraction/deployment gear 202, in FIG. 2, which is rotationally meshed with gear 106, which is driven by drive motor 103. The rotation of drive motor 103 imparts rotation to drum 100 via the meshed gearing to deploy or retract line 108. While the above has been described as retracting upward and deploying downward, the retraction device according to the present invention may retract or deploy in any direction and/or orientation.

In addition to the drive motor 103, the motor controller 102 is also included in retraction device 50. Motor controller 102 is a servo drive or similar device that is capable of being connected in a serial arrangement. In one embodiment, as shown in FIG. 2, the motor controller 102 is connected with a power and signal cable 111. The motor controllers 102 are arranged in a substantially serial-type or network arrangement, wherein the cable 111 preferably connects to the motor controller 102 such that the motor controllers 102 are networked in a configuration that permits the utilization of a series of cable 111 connections between motor controllers 102. Motor controller 102 is addressable in that particular motor controllers 102 within the network of serially connected motor controllers 102 may be operated in response to a signal addressed or provided to the particular motor controller via cable 111. For example, in a series of motor controllers 102 or a plurality of motor controllers 102, signals may be provided indicating that the line 108 is to be retracted sufficiently to draw a portion of the barrier 110 upwardly, remain in position for a predetermined time and subsequently deploy the line 108 to allow the barrier 110 to descend toward the stage or other underlying structure. In the above example, the motor controllers 102 that are addressed in the signal retract/deploy lines 108 accordingly, wherein additional motor controllers 102 that are not addressed in the signal remain in position, i.e., do not retract/deploy corresponding lines 108. The cable 111 may be any suitable cable arrangement, including a copper, fiber optic and/or other signal/power conveying device and combinations of multiple types of signal/power conveying devices. For example, cable 111 may include alternating current (AC) or direct current (DC) power and Ethernet signal. Motor controller 102 includes power line 201 to the drive motor 103 in response to signals received along cable 111 and feedback line 204 received from drive motor 103 (see e.g., FIG. 2). Power line 201 may include voltage and/or current applied or switching signals to power drive motor 103. In an alternate embodiment, power signals via signal line 201 may be variable and provide variable power to drive motor 103. In addition, feedback line 204 may include signals corresponding to position, velocity, acceleration, torque or any other measurable parameter suitable for providing control to the drive motor 103.

The portable barrier retraction device 50 is detachably affixed to support frame 101 and is attachable in a variety of locations. The support frame 101 preferably includes beams, tubular supports or other structures for mounting the portable barrier retraction device 50. In one embodiment of the invention each portable barrier retraction device 50 is substantially identical, allowing installation in any order and according to a variety of configurations. In addition, the portable barrier retraction device 50 may be exchanged, replaced and/or easily repaired, wherein the removal and/or replacement is easy and requires little time or technical skill.

FIG. 2 shows an enlarged view of barrier retraction device 50, including drive motor 103 in a geared arrangement with drum 100 through gear 106. It is to be understood that electrical, electromechanical, hydro-mechanical or other arrangement that provide similar selective rotation between drive motor 103 to drum 100 are also contemplated. Drum 100 includes a retraction/deployment gear 202 and spools 205 and 207 mounted on a shaft 209. The present invention is not limited to this arrangement and may include any configuration that provides deployment and/or retraction of line 108 in response to rotation or movement of drive motor 103. Spools 205, 207 may be spools or any other device capable of storing and deploying or retracting line 108 in response to rotation of shaft 209. The geometry of the first and second spools 205 and 207 may include any suitable geometry that is capable of receiving line 108 and deploying line 108, including, but not limited to cylindrical or elliptical bodies. First and second spools 205 and 207 may also include additional guides or structures for aligning or reducing tangling of lines 108 to facilitate reliable retraction and deployment of line 108. Drum 100 may be attached to the barrier retraction device 50, may be attached to the support frame 101 or may be supported in a position adjacent to the barrier retraction device 50 in any suitable manner that provides meshing engagement between gear 106 and retraction/deployment gear 202.

In one embodiment of the present invention, retraction of the barrier 110 is provided when line 108 is drawn onto the first spool 205 and second spool 207 within detachable drum 100. The drive motor 103 imparts rotation gear 202 via gear 106, which in turn rotates the first and second spools 205 and 207 and facilitates the retraction of line 108. To deploy the barrier 110, the drive motor 103 is rotated or allowed to rotate in the opposite rotational direction used to retract barrier 110, wherein the first spool 205 and the second spool 207 rotate in a manner that extends the length of the line 108 around and/or attached to barrier 110. While FIG. 2 shows first and second spools 205 and 207, the present invention may utilize one or more than two spools to retract or deploy line 108. The use of two or more spools permits the line 108 to be drawn in and deployed at a greater speed, due to a plurality of spools each drawing in line 108 or deploying line 108 at a rate corresponding to the rate of rotation of drive motor 103, as translated through the gearing arrangement between gear 106 and retraction/deployment gear 202. In addition, the spools 205, 207 may be configured with gearing or other similar arrangements to increase or decrease the rate of retraction or deployment of line 108 with respect to retraction/deployment gear 202 and/or increase or decrease the rotational force required to retract or deploy line 108.

Other structures such as locking devices or pawls on the gears 106 and 202, which selectively engages the gears 106, 202 may be provided and permit holding of the line 108 (i.e., holding the lower edge of barrier 110) in a given location without additional stress of the drive motor 103 or the other components rotationally connected thereto.

Figure 3:
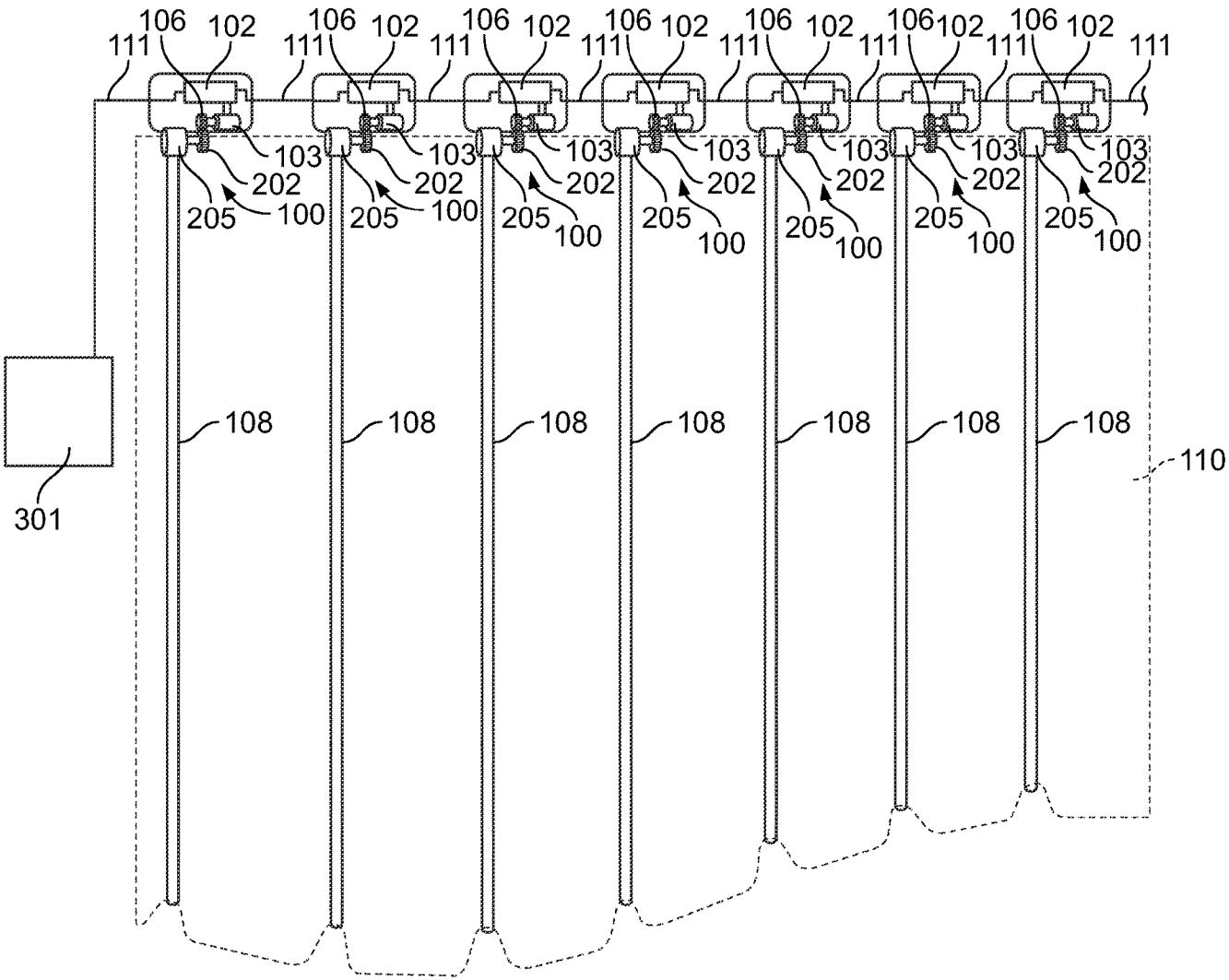
FIG. 3 shows a perspective elevational view of a barrier retraction system according to another embodiment of the present invention.

FIG. 3 illustrates a schematic view of a barrier retraction system having a plurality of barrier retraction device 50 according to an embodiment of the present invention. The arrangement shown in FIG. 3 includes the arrangement of the system arranged in a serial-type network of cable 111. The utilization of the serial arrangement permits the cable 111 to enter the motor controllers 102, wherein a second cable extends from one motor controller to the next, preferably adjacent, motor controller 102. The arrangement is continued until all of the motor controllers 102 are connected in a serial arrangement. This arrangement permits easy connection of the motor controllers 102. The connection is preferably by plug in connectors or similar connections, and allow the barrier retraction device 50 to extend for long distances wherein cable 111 need only be run in a single cable 111 spanning between motor controllers 102 for the entire network of motor controllers 102. The cable 111 terminates or originates at controller 301, which provides addressable signals to each of the motor controllers 102, as desired. Controller 301 is a microprocessor or other device capable of providing addressable signals to individual barrier retraction devices 50 via the network formed by the connections of cable 111. Controller 301 may be programmed with preselected arrangements of signals or may be operated in a manner to provide the desired signals by an operator. The signals provided to the barrier retraction device 50 are received by the motor controller 102, which operates the drive motor 103 in response to the signal from controller 301 and the feedback line 204 (FIG. 2). The capability for individual operation of the motor controllers 102 allows selective retraction of barrier 110. As discussed above with respect to FIGS. 1 and 2, barrier retraction devices 50 are configured to independently increase (e.g., deploy) or decrease (e.g., retract) the length of line 108 adjacent or attached to barrier 110 in response to signals received by motor controller 102. As the length of line 108 is decreased, the barrier 110 is drawn in a direction toward barrier retraction device 50. Likewise, as the length of the line 108 increases, the barrier 110 is deployed.

Alignment is desirable during assembly of the barrier 110 and retraction system, wherein sizing of the components may be dependent, for example, on stage heights or barrier system mounting locations. That is, in one embodiment, either/both stage heights and barrier systems mounting locations can differ along different portions of the barrier 110. In addition, newly installed components, including replacement barriers 110 or replacement drums 100 may be quickly and easily configured to the height required for the particular assembly of the barrier retraction system. As shown in FIG. 3, the barrier 110 may be retracted in a non-uniform pattern. In order to retract barrier 110, controller 301 transmits a signal via cable 111 to the motor controllers 102 instructing the motor controllers 102 to retract or deploy barrier 110 in the desired manner. The signals sent via cable 111 are addressable, in that, the signal, although transmitted along a single cable 111, provide instructions to one or more preselected motor controllers 102, wherein the parameters utilized by the motor controllers 102 may be configured to provide a desired operation of a particular barrier retraction device 50. For example, if it is desired to have an opening drawn in the barrier 110 at a location at or near the center of the barrier 110 (e.g., an opening sufficient to permit a person to walk through), the barrier retraction devices 50 at or near the center of the barrier 110 may be configured via signals from controller 301 to retract sufficiently to permit a person to pass beneath the center portion of the barrier 110, while the remaining barrier retraction devices 50 remain in a set position, i.e., non-centered portions of barrier 110 remain lowered. The invention is not limited to this embodiment and may include adjusting the lines 108 for the barrier 110 in order to cover a stage or platform. For example, the lengths of line 108 for deployment and retraction desirable for a particular application is dependent upon a variety of factors, including but not limited to, the height of the stage or platform utilizing barrier 110, the height of the structure to which support frame 101 may be attached, desired retraction/deployment rate, the desired retraction pattern (i.e., scallop, festoon or other retraction pattern), and a variety of other factors relating to the particular venue of the theatrical or concert event. In addition, the barrier retraction devices 50 may be adjusted for sloped, angles or stages having variable or asymmetrical geometry.

Figure 4:
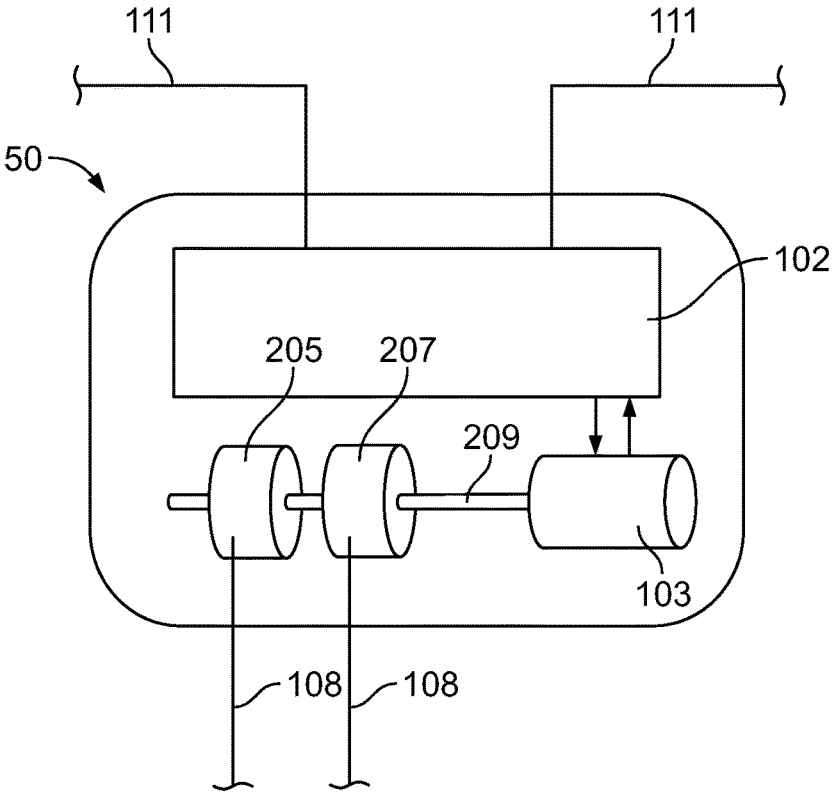
FIG. 4 shows an enlarged view of a barrier retraction device according to an embodiment of the present invention.

FIG. 4 illustrates an enlarged view of barrier retraction device 50, including a retraction assembly having drive motor 103 in a rotational relationship with spools 205 and 207. In this embodiment of the invention, drive motor 103 rotates in response to a signal from motor controller 102, wherein the drive motor 103 rotates shaft 209, which thereby rotates spools 205 and 207 in a manner that deploys or retracts line 108. Although FIG. 4 shows a rotational shaft arrangement and the utilization of a plurality of spools 205, 207, any configuration that provides actuation of a line 108 retraction and/or deployment device operated by drive motor 103 may be utilized.

Figure 5:
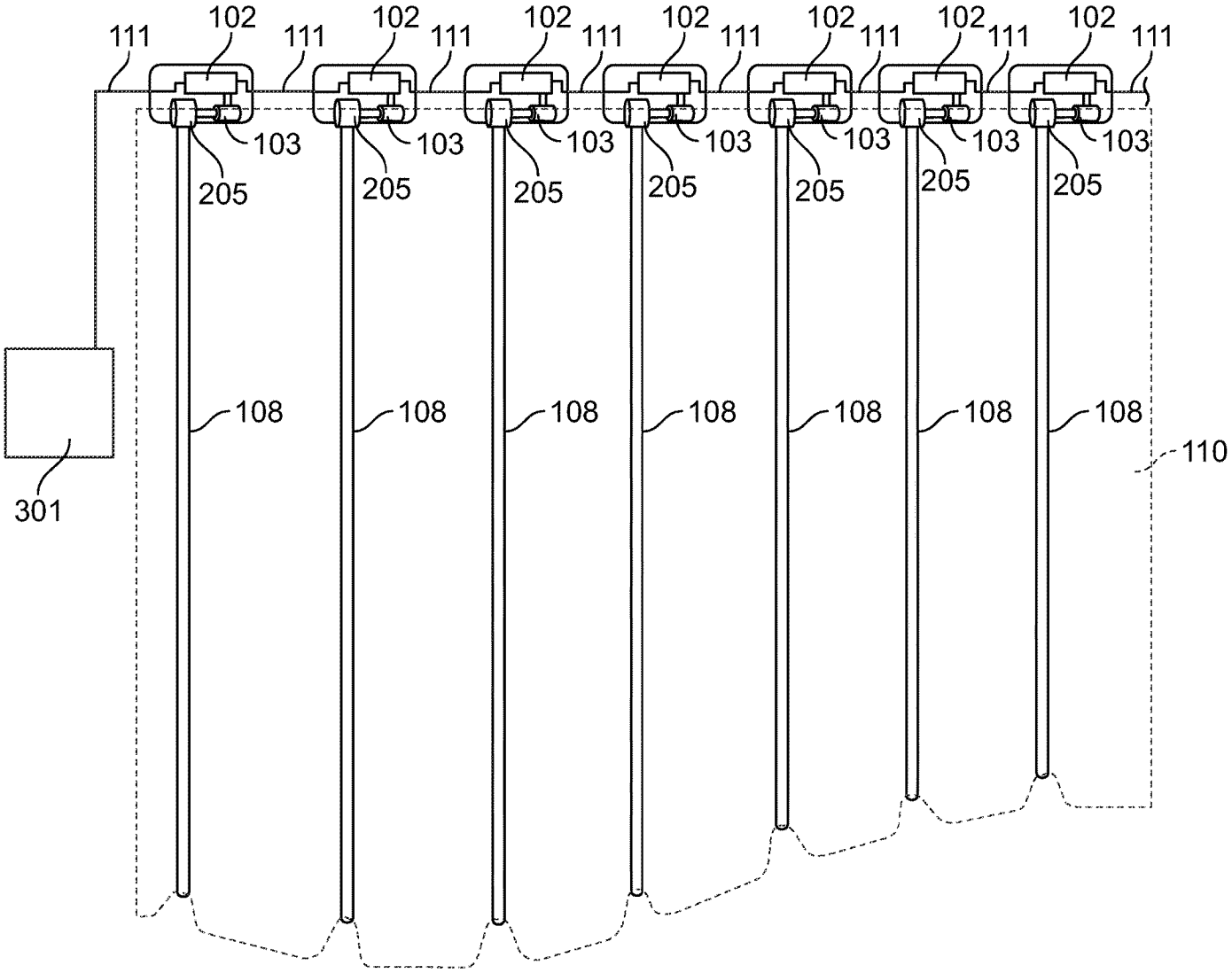
FIG. 5 shows a perspective elevational view of a barrier retraction system according to another embodiment of the present invention.
Figure 6:
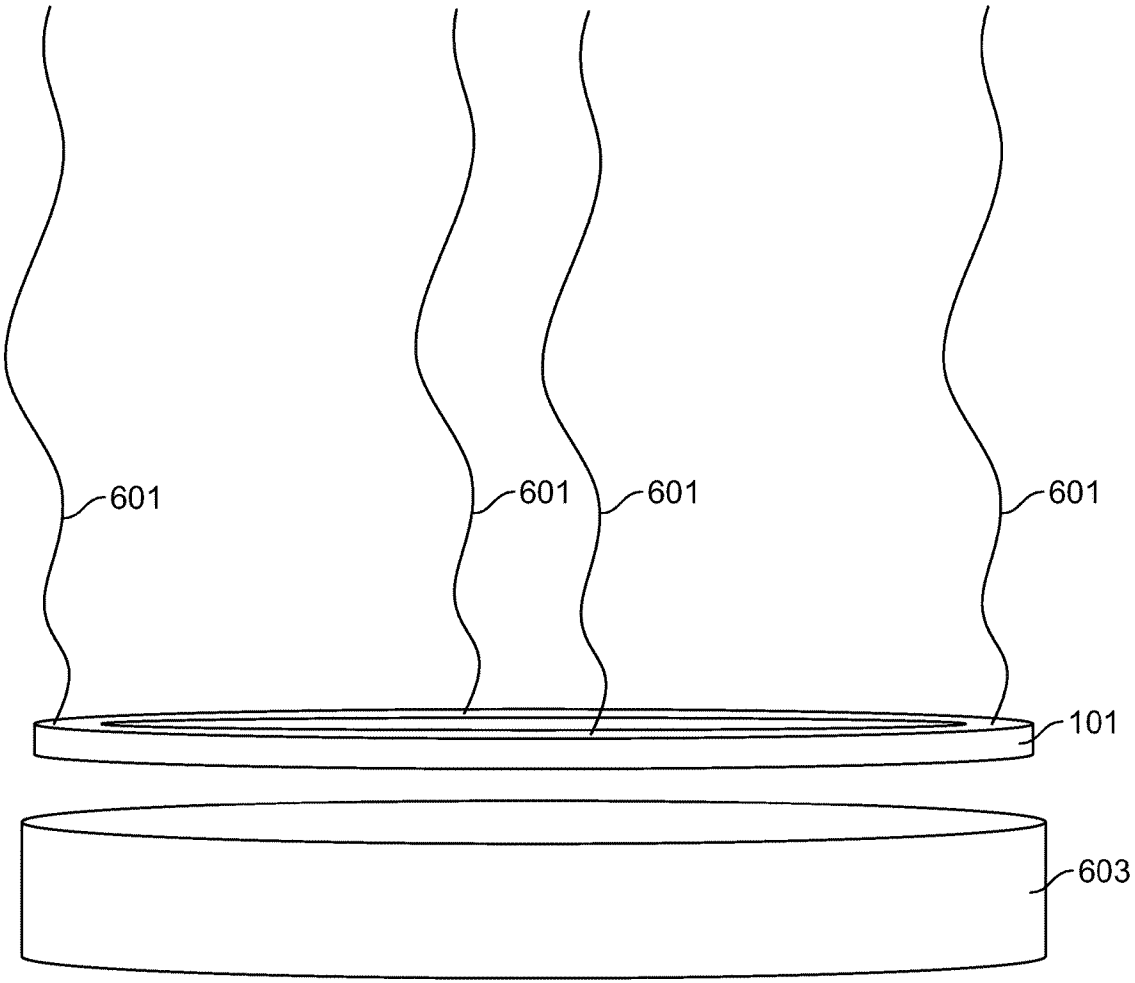
FIGS. 6-10 show a perspective elevational view of a barrier retraction system at different stages of assembly according to an embodiment of the present invention.

FIG. 5 illustrates a schematic view of a barrier retraction system having a plurality of barrier retraction devices 50 according to another embodiment of the present invention. The arrangement shown in FIG. 5 utilizes barrier retraction devices 50 having the arrangement shown in FIG. 4. The configuration of the barrier retraction devices 50 includes the system arranged in a serial-type network of cables 111. The system of FIG. 5 operates substantially the same as the system of FIG. 3, wherein signals from controller 301 configure drive controllers 102 to provide desired line 108 retraction and/or deployment. The drive motor 103 rotates in response to signals from motor controller 102, which, in turn, rotates shaft 209. The rotation of shaft 209 rotates spools 205, 207, which retract and/or deploy line 108.

The barrier retraction system according to one embodiment of the present invention is portable and easily assembled and disassembled. Portable, as utilized herein, means that the components are detachable into component units that are sized for storage and/or transport. In one embodiment, the component units are configured to a size that fits within a conventional tractor-trailer and/or the cargo hold of a 747, or similar aircraft and/or the cargo hold of a sea vessel. In addition, the components of barrier retraction system may be arranged and/or discreetly labeled in order to provide quick and accurate assembly. For example, the barrier 110 is preferably detachable from drum 100, support frame 101 and/or the barrier retraction device 50. In addition, the support frame 101, and drum 100 preferably disassemble into separate components that are sufficiently small to fit into the cargo hold of a tractor-trailer and/or cargo aircraft or other transport vessel.

Figure 7:
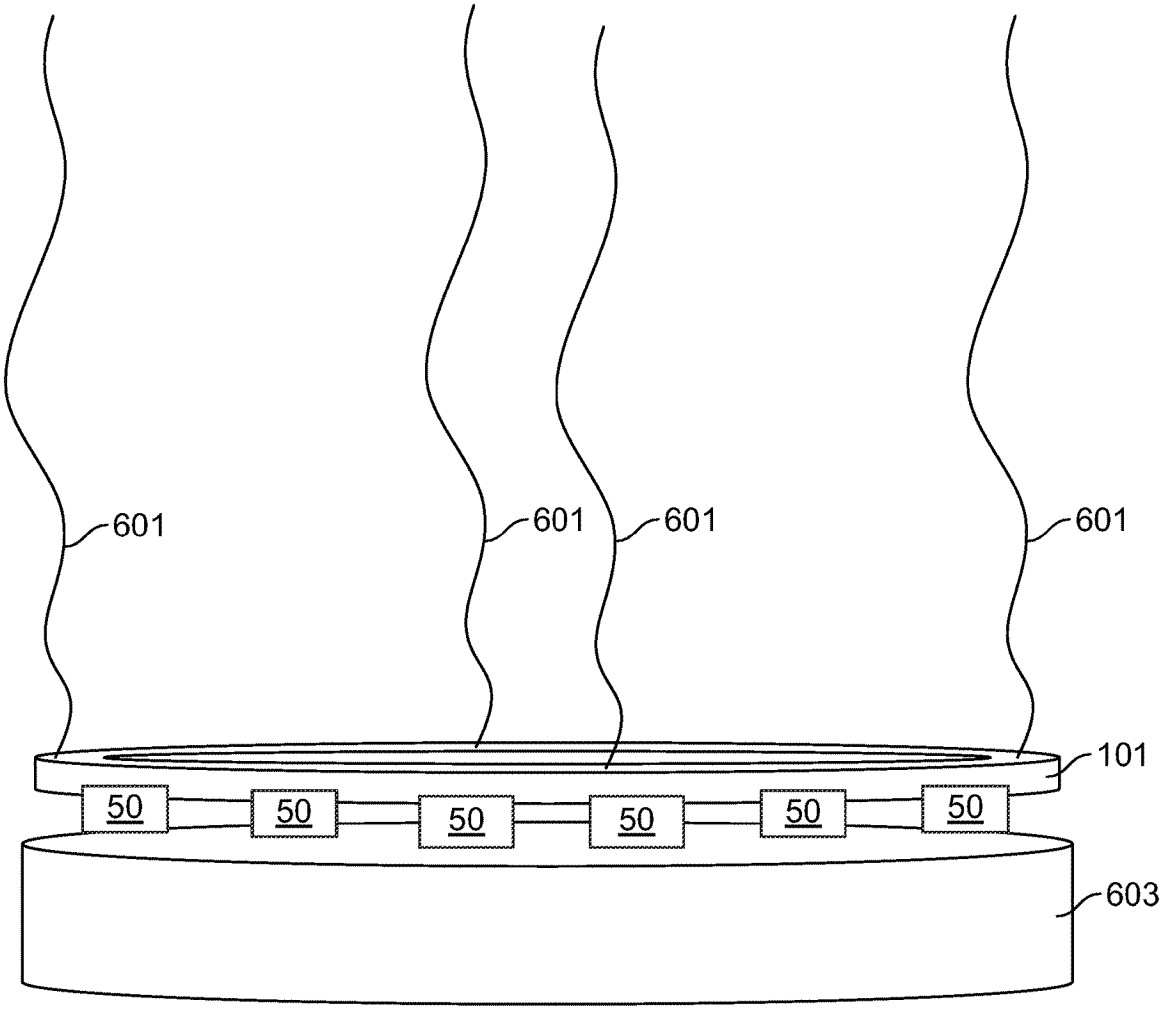

FIGS. 6-10 illustrate an assembly method for assembling a barrier retraction system according to an embodiment of the present invention. To provide a barrier 110 or curtain for use with a stage 603, a support frame 101 may be suspended by wires 601 or other support mechanism. The support frame 101 may be configured into any suitable geometry and preferably includes a geometry that corresponds to a stage 603 or stage element wherein barrier 110 placement is desired. In addition to supporting the barrier 110, the support frame 101 may include supports for lighting, sound or other equipment associated with a theatrical performance. As shown in FIG. 7, barrier retraction devices 50 may be attached to support frame 101 in any suitable manner, including, but not limited to bolting, screwing, quick release fasteners or any other suitable fastening means. The barrier retraction devices 50 are preferably attachable to the support frame 101 at locations along the support frame 101. The positioning of the barrier retraction devices 50 may be functional or decorative, so long as sufficient support to barrier 110 is present to permit retraction and/or deployment of the barrier 110. In one embodiment, the support frame 101 and barrier retraction devices may be attached in various locations, which may be marked with indicia of a particular assembly order or component identification, which reduces assembly error and decreases assembly time. In addition, the utilization of a substantially identical set of barrier retraction devices 50 permits interchangeability for replacement and/or repair. Barrier 110 and drum 100 may be attached with barrier retraction device 50 or may be attached subsequent to the attachment of barrier retraction device 50. As discussed above, drum 100 may be attached to the barrier retraction device 50, the support frame 101 or to any other structure that permits support adjacent to barrier retraction device 50. For simplicity, in FIGS. 6-10, barrier retraction device 50 is shown as a unitary component, wherein, the component includes drum 100. In addition, in the embodiment shown in FIGS. 4 and 5, the barrier retraction device 50 may include the spools 205, 207 in rotational communication with drive motor 103.

Figure 8:
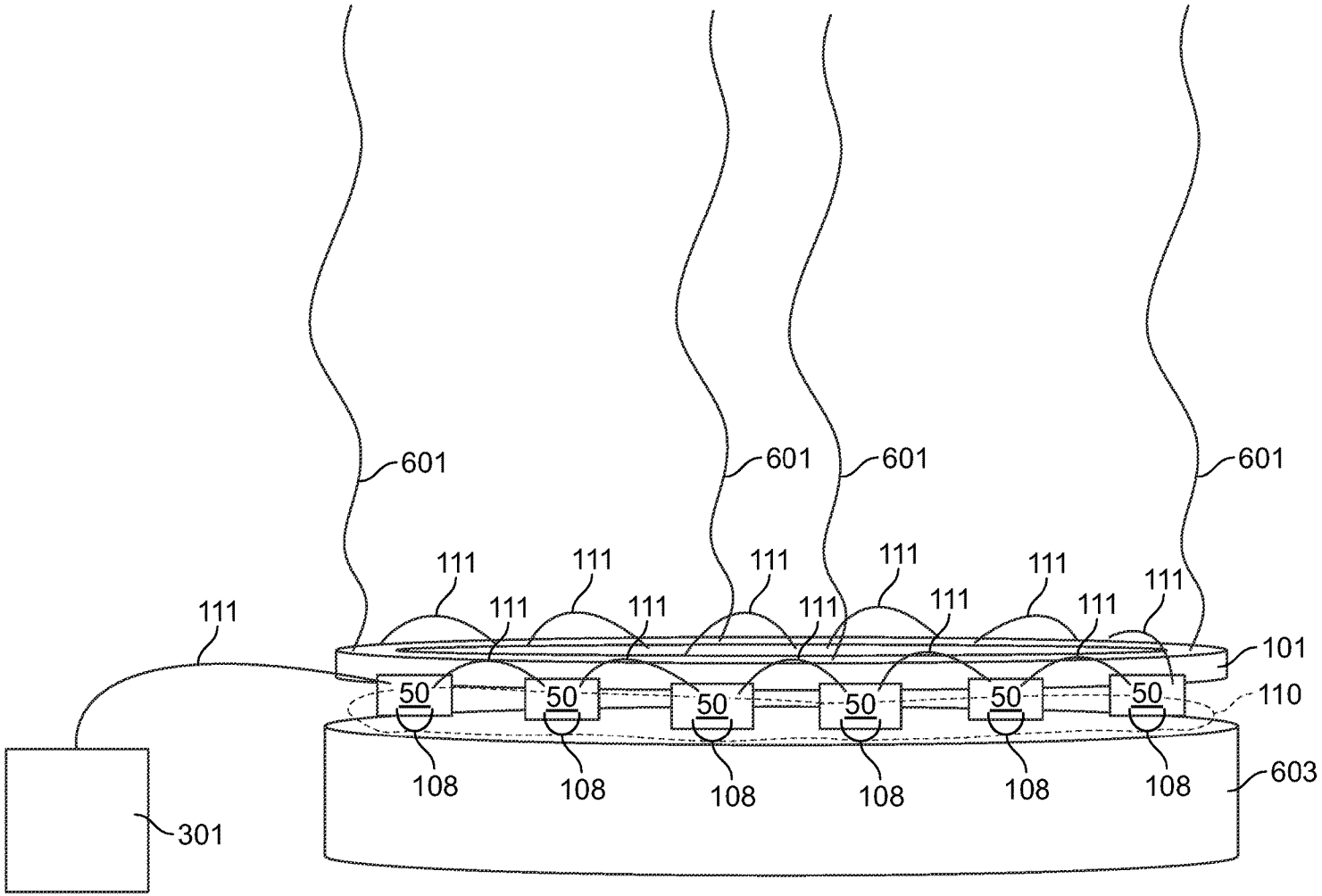

FIG. 8 shows the connecting of cables 111 to the barrier retraction devices 50 in a serial manner to form a networked group of barrier retraction devices 50. Also shown is the positioning of barrier 110 with respect to the barrier retraction devices 50. The cables 111 are connected to the motor controls 102 of each of the barrier retraction devices 50, wherein controller 301 is connected to at least one end of the serial arrangement. In one embodiment, cables 111 are configured with connectors, such as prefabricated copper, Ethernet cables, coaxial cables, fiber optic cables or bundles having Ethernet/fiber optic and power cables, having connectors at each end, which engage and connect each of the barrier retraction devices 50 in a chain, as shown in FIG. 8. The utilization of cables 111 having connectors that are easily aligned, connected and disconnected allows connections of the components quickly with few or no errors in configuration, even when connections are being made by personnel having little or no technical skill.

Figure 9:
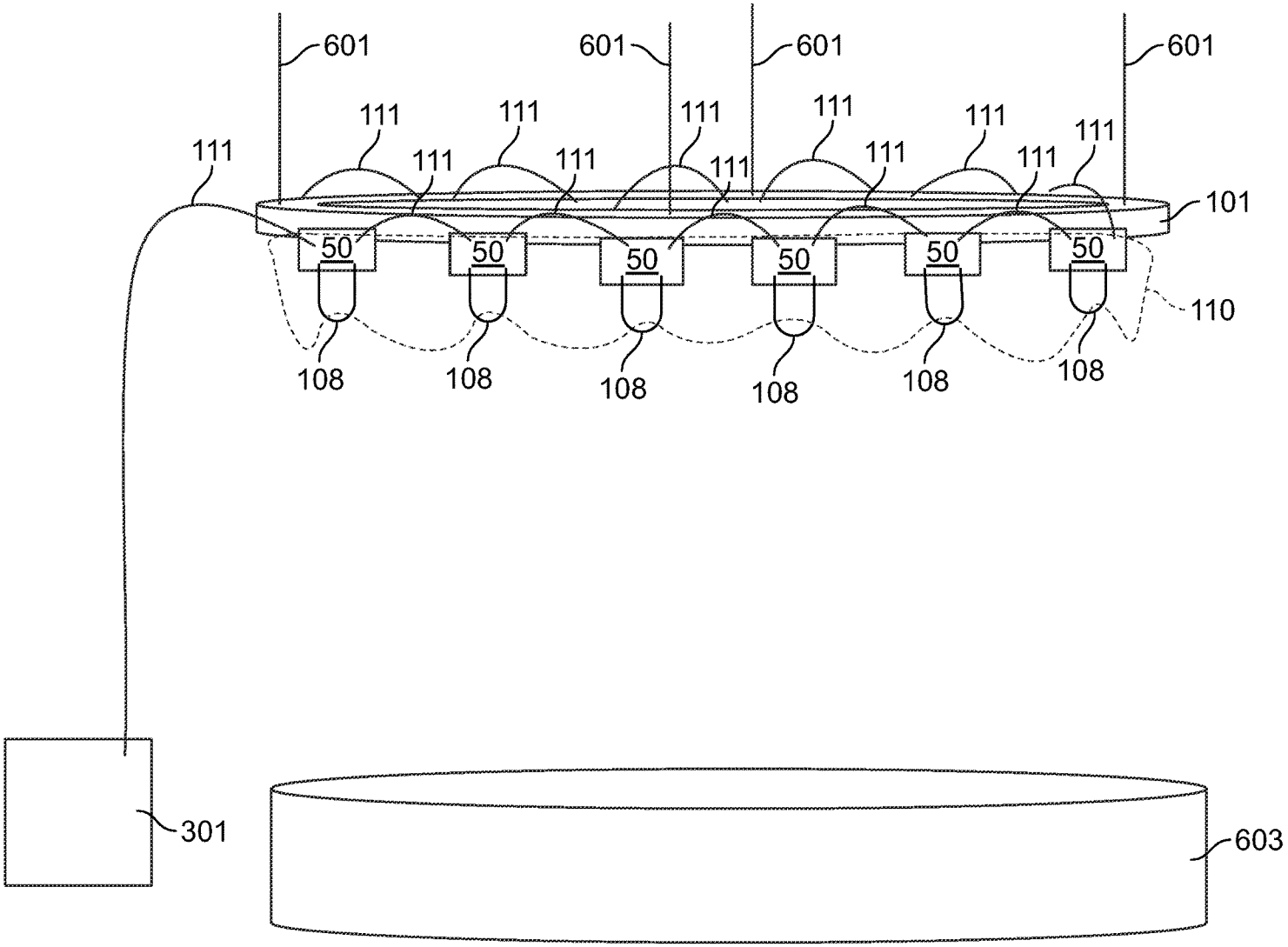
Figure 10:
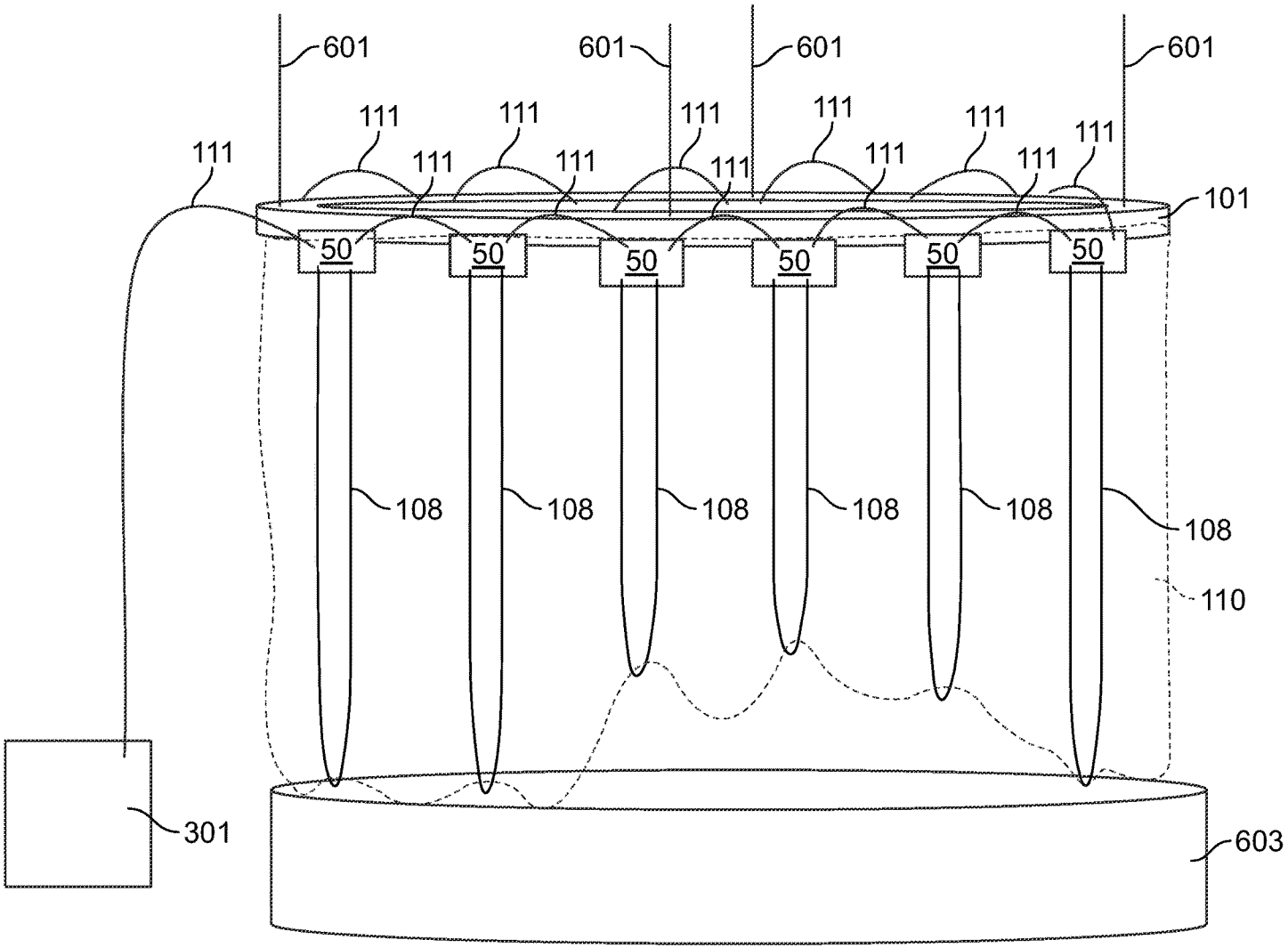

FIG. 9 illustrates the lifting of the barrier system by wires 601. As shown in FIG. 9, the barrier retraction devices 50 include barrier 110 and line 108. The sizing of lines 108 may provide individual lengths along barrier 110 that provide the desired alignment. For example, the lines 108 may be drawn to a length corresponding to a festoon at a substantial uniform height above stage 603. In addition, as shown in FIG. 10, the lines 108 may be drawn unevenly providing for desired visual effects or openings to permit personnel to pass underneath the raised portion of the barrier 110. As discussed above, prior to lifting or subsequent to lifting, the support frame 101 may include additional components for the theatrical performance, such as lighting or sound components.

The assembly of the stage and the barrier retraction system including the barrier retraction devices 50 may be accomplished utilizing personnel having little or no technical skill, wherein the positioning of the components is customizable, permitting adjustment of the components and allowing components to be utilized interchangeably in various locations along the support frame 101. The interchangeability and the flexibility in positioning permits adjustments, repair and alternate configurations that may be accomplished quickly and before, during or after assembly of the system.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

The invention claimed is:

1. A portable barrier retraction system comprising:

a barrier having at least one line disposed adjacent thereto, a controller capable of providing an addressed signal;

one or more barrier retraction devices detachably affixed to a support frame, the one or more barrier retraction devices comprising:

a drive motor having an addressable drive motor control;

the drive motor being connected to the drive motor control with a power line and a feedback line, wherein the drive motor control is a servo drive and provides variable control of one or more of velocity, acceleration, and torque to the drive motor; and the drive motor being in rotational communication with at least one retraction assembly configured to retract or deploy the line in response to rotation of the drive motor, the line being configured to retract or deploy the barrier;

wherein the drive motor provides independent selective rotation to the at least one retraction assembly in response to an addressed signal from the controller, power from the drive motor control and feedback from the drive motor;

wherein the controller is capable of providing the addressed signal in response to direct input from an operator;

wherein the system is portable and the barrier, the one or more barrier retraction devices, and the support frame are capable of quick assembly and disassembly via quick release fasteners; and wherein the drive motor control of each of the one or more barrier retraction devices is capable of being connected in serial arrangement with other drive motor controls in any order.

2. The system of claim 1, wherein the retraction assembly includes a rotatable shaft in rotational communication with the drive motor.

3. The system of claim 1, wherein the barrier is a theatrical curtain.

4. The system of claim 1, wherein the at least one retraction assembly comprises at least one spool mounted on a rotatable shaft, the rotatable shaft being in rotational communication with the drive motor, the at least one spool being configured to retract or deploy the line in response to rotation of the rotatable shaft.

5. The system of claim 1, wherein the barrier, the at least one barrier retraction device and the frame disassemble into components that are capable of being stored in a cargo container transportable on a cargo aircraft.

6. The system of claim 1, wherein the controller is preprogrammed.

7. The system of claim 1, wherein the addressable drive motor controls is configured to increase the rate of rotation in comparison to the one or more other addressable drive motor controls.

8. The system of claim 1, wherein the barrier retraction system is configured to operate in a plurality of stage heights.

9. The system of claim 1, wherein the at least one barrier retraction device is marked with indicia for a particular assembly order.

10. The system of claim 1, wherein the at least one barrier retraction device is configured to be affixed to the barrier in various locations.

11. The system of claim 1, wherein the at least one barrier retraction device is attached along preselected areas of the support frame.

12. The system of claim 1, wherein the at least one barrier retraction device includes alternate configurations.

13. The system of claim 1, wherein the servo drive controls position of the drive motor in response to the addressed signal from the controller.

14. The system of claim 1, wherein the servo drive controls velocity of the drive motor in response to the addressed signal from the controller.

15. The system of claim 1, wherein the servo drive controls acceleration of the drive motor in response to the addressed signal from the controller.

16. The system of claim 1, wherein the servo drive controls torque of the drive motor in response to the addressed signal from the controller.

17. The system of claim 1, wherein the drive motor is configured to be detached individually.

18. A portable system for retracting and deploying a curtain, the system comprising:

a support frame; and a serial network comprising:

a first motorized device releasably attached to the support frame, the first motorized device comprising:

a first drive motor having a first addressable drive motor control, the first drive motor being in rotational communication with a first retraction assembly configured to retract or deploy a first line in response to rotation of the first drive motor;

the first drive motor being connected to the first drive motor control with a power line and a feedback line, wherein the first drive motor control is a servo drive and provides variable control of one or more of velocity, acceleration, and torque to the first drive motor;

a second motorized device releasably attached to the support frame, the second motorized device comprising:

a second drive motor having a second addressable drive motor control, the second drive motor being in rotational communication with a second retraction assembly configured to retract or deploy a second line in response to rotation of the second drive motor;

the second drive motor being connected to the second drive motor control with a power line and a feedback line, wherein the second drive motor control is a servo drive and provides variable control of one or more of velocity, acceleration, and torque to the second drive;

a controller configured to generate addressed signals;

a first cable connecting the controller and the first addressable drive motor control, the controller being in addressable electrical communication with the first addressable drive motor control by way of the first cable; and a second cable connecting the first addressable drive motor control and the second addressable drive motor control, the controller being in addressable electrical communication with the second addressable drive motor control by way of the first cable and the second cable;

wherein the controller is capable of providing the addressed signal in response to direct input from an operator;

wherein the first drive motor and second drive motor provide independent selective rotation to the first retraction assembly and the second retraction assembly in response to an addressed signal from the controller, power from the first and second drive motor controls, respectively, and feedback from the first and second drive motors, respectively;

wherein the system is portable and the barrier, the at least one barrier retraction device, and the support frame are capable of quick assembly and disassembly via quick release fasteners; and wherein the first motorized device and the second motorized device are interchangeable.

19. The system of claim 18, wherein the curtain, the first motorized device, the second motorized device, and the support frame are capable of quick assembly and disassembly via quick release fasteners.

* * * * *